US006009649A

United States Patent [19]

Bianchi

[11] Patent Number: 6,009,649

[45] Date of Patent: Jan. 4, 2000

[54] PROMOTIONAL AMUSEMENT DEVICE

[76] Inventor: Michael Bianchi, 895 Hampton Dr., Carol Stream, Ill. 60188

[21] Appl. No.: 09/178,799

[22] Filed: Oct. 26, 1998

[51] Int. Cl.[7] ..... G09F 13/00

[52] U.S. Cl. ..... 40/553; 40/586; 362/102; 362/202

[58] Field of Search ..... 40/586, 553, 555, 40/564; 340/321, 473; 362/102, 109, 202, 198, 363

[56] References Cited

U.S. PATENT DOCUMENTS

| | | | |
|---|---|---|---|
| 1,776,182 | 9/1930 | Cook | 40/555 |
| 2,647,254 | 7/1953 | Brunnhoelzl | 340/321 |
| 5,287,255 | 2/1994 | Strodtman | 362/102 |
| 5,493,480 | 2/1996 | Huang | 362/102 |
| 5,642,931 | 7/1997 | Gappelberg | 362/186 |

*Primary Examiner*—Terry Lee Melius
*Assistant Examiner*—J M Hewitt
*Attorney, Agent, or Firm*—Basil E. Demeur; Alan B. Samlan; Robert L. Knechtel

[57] ABSTRACT

A promotional amusement device including a handle element which includes a grip portion at its lower end, and a spherical globe portion at the upper end. A series of three telescopically arranged tubular members are arranged to be nestled within the handle member, and including a spring member associated with the tubular members in order to extend the tubular members into a fully extended position. A transparent stretchable boot is provided and arranged to be nested within the upper spherical globe portion of the handle, and includes a top cap mounted on the inner most tubular member and which also provides a rest point for the transparent stretchable boot. Upon release of the spring member, the tubular members are fully extended to the open position and carry with it the transparent stretchable boot to its fully extended position. The boot, spherical globe portion and handle member are all adapted to carry promotional indicia thereon which are displayed when the boot is fully extended by the tubular members. The lower handle member is also provided with a light source and switch means for activating and deactivating the light such that when the boot is fully extended, the light may be energized in order to light up the indicia imprinted on the boot.

17 Claims, 3 Drawing Sheets

PROMOTIONAL AMUSEMENT DEVICE

BACKGROUND OF THE INVENTION

The present invention generally relates to a promotional amusement device which is adapted to carry any number of messages or promotional indicia imprinted thereon. It is intended that the promotional indicia may take any format such as the promotion of a sports team, a variety of consumer products, or simply an amusement device.

The promotional amusement device of the present invention is intended to be hand held, and includes a light source contained within the device which is powered by portable power means such as, for example, typical batteries. An on/off switch is provided in order to energize and de-energize the light source. It is intended that when the device is appropriately activated and the tubular members are extended which, concomitantly, extends the transparent stretchable boot, the indicia imprinted thereon are displayed, and by activating the light source, the indicia are lighted for display purposes. Hence, the device is useful both day and night as a promotional or amusement device.

A variety of prior art devices have been developed which include a hand held member of some type, and provide for some type of extendible members contained within the hand held chamber. Generally, such devices have a particular purpose, and the precise purpose of the device dictates its construction and mechanical interrelationships. For example, U.S. Pat. No. 5,493,480 is directed to an illuminated umbrella device, which includes a series of telescopically arranged tubular members having an umbrella at the upper end, and a grasp handle at the lower end. The tubular members are collapsible down to a nested position with the umbrella section being foldable downwardly into its closed position such that the device is easily hand held. Upon releasing of a spring mechanism, the spring urges the tubular members to advance to the fully extended position and concomitantly open the umbrella to provided an umbrella device. The handle is adapted to contain a light with a battery power source, which operates to illuminate the umbrella.

Another prior art device is illustrated and depicted in U.S. Pat. No. 5,287,255 which is directed to a combination flashlight and extendible baton. The intended purpose of the device is to provide a flashlight for security purposes, such as the type that would be used by law enforcement security personnel, and to have incorporated therein an extendible baton device which is nested within the handle of the flashlight. When it is intended to be used as a defensive weapon, the baton portion is telescoped out of the flashlight handle and forms a defensive weapon.

Another device which again consists of a hand held device is shown in U.S. Pat. No. 4,744,013, which is again denoted as a baton capable of illumination and sound. In this case, the base generally consists of a flashlight type device, which is adapted to carry at its lighted end, a series of three collapsible tubular members which are extended to a fully open position or collapsible to be carried as a flashlight type device. According to the description in the aforesaid patent, the device is intended as a combination flashlight and whistle baton in the nature of a defensive weapon.

In terms of collapsible devices which are intended to carry a message, U.S. Pat. No. 2,819,547 illustrates a subterranean telescoping sign. As shown and described in the aforesaid patent, the device is intended to be inserted within a subterranean mounting, and is extendible to a fully open position, the top end which includes some type of signage such as, for example, traffic control signage. When the device is intended to be used, a plug is pulled in order to extend the device upwardly, and permitting the signage carried at the top to open by means of a pair of springs. When the device is meant to be out of use, the device is simply pushed downwardly into the subterranean canister, and the lid closed.

The prior art demonstrates a number of other types of devices which have special uses and purposes. Each device, as was indicated previously, is constructed in a special manner in accordance with the particular use to which the device is intended to be applied.

In accordance with the present invention, the present invention is intended to permit a user to display various types of promotional or advertising messages, both day and night, and just as importantly, to provide promotional indicia for either various services or products. For example, it is contemplated that the present invention can be utilized as a device for promoting a particular sports team, and hence, the logos and names of the sports team may be printed on the device and which when used by the consumer, promotes the consumer's favorite team.

OBJECTS AND ADVANTAGES

It is therefore the principal object of the present invention to provide a promotional amusement device which may be hand held, and is easily adapted for use by the consumer merely by the pressing of a release button in order to activate the device in order to display the promotional indicia contained thereon.

Further, the object of the present invention is to provide a hand held promotional amusement device which is formed from materials which are user friendly, and minimizes any possible danger to the user thereof, including small children.

Hence, a principal object of the present invention is to provide a promotional amusement device which in general consists of a hand held handle member, which is formed by an upper chamber and a lower chamber. The lower chamber contains a plurality of telescoping tubular members which are intended to be nested within the lower handle chamber when in the storage posture, but fully extendible to an open position by means of a coil spring which may be activated by a release button contained on the handle member. A transparent stretchable boot is provided, which in the nested storage position, is nested within the upper handle chamber, but which is freely extendible to its fully open position by means of the telescoping tubular members. The transparent stretchable boot is formed of a light-permeable material, adapted to contain indicia imprinted thereon such that when it is extended to its fully open position, it will display such indicia Further, the lower handle chamber is provided with a light source and portable power means such as batteries, which when activating the light source, will permit the indicia contained on the boot to be lighted for display purposes at night.

Other objects and advantages consist of providing a promotional amusement device of the general type described, wherein a spring member provided for extending the tubular members is designed in order to function to fully extend the tubular members when activated, but to do so with a spring rate which avoids any potential safety hazard to the user thereof, especially small children. The end cap which is provided and carries the transparent stretchable boot to its fully extended position is formed of a user friendly soft resinous material so that when the device is activated in order to fully extend the tubular members to their fully extended position, any potential safety hazard to the user is minimized or eliminated since the end cap, even if it should strike the user, will not cause any damage or danger to the user.

The above objects and further objects and advantages of the present invention will best be understood by reference to the following specification taken in conjunction with the accompanying drawings.

SUMMARY OF THE INVENTION

In summary, the present invention provides a promotional amusement device which is formed by an elongate handle member forming an upper handle chamber having an open top end and a lower handle chamber terminating in a base with a concavity at the lower end thereof. A series of telescoping tubular members are arranged to be nested into the lower handle chamber for storage purposes, and extendible into their fully extended position by means of a spring element which is released by a release button in order to urgingly extend the tubular members to their fully extended open position. The upper handle chamber is adapted to contain a transparent stretchable boot stored therein, the upper handle chamber having an open top end which is enclosed by a top cap which is secured to the inner most tubular member. The transparent stretchable boot extends over the end cap, and hence, when the spring element is released by the release button and urgingly extends the tubular members to their fully extended position, the end cap will similarly move upwardly and carry or push the transparent stretchable boot to its fully extended position. The end cap, transparent stretchable boot, and handle are all adapted to be imprinted with promotional indicia.

The handle element is also provided with a light source similar in nature to a flash light, and energized by batteries, with a light switch, ideally contained within the concavity in the base. Once the device has been activated to extend the tubular members upwardly, and hence, the stretchable boot upwardly, the light source may be activated in order to light the boot, which will in effect display the promotional indicia on the boot as well as on the handle even at night time.

DETAILED DESCRIPTION OF DRAWINGS

The following drawings are provided in order to illustrate the invention.

Figure 1:
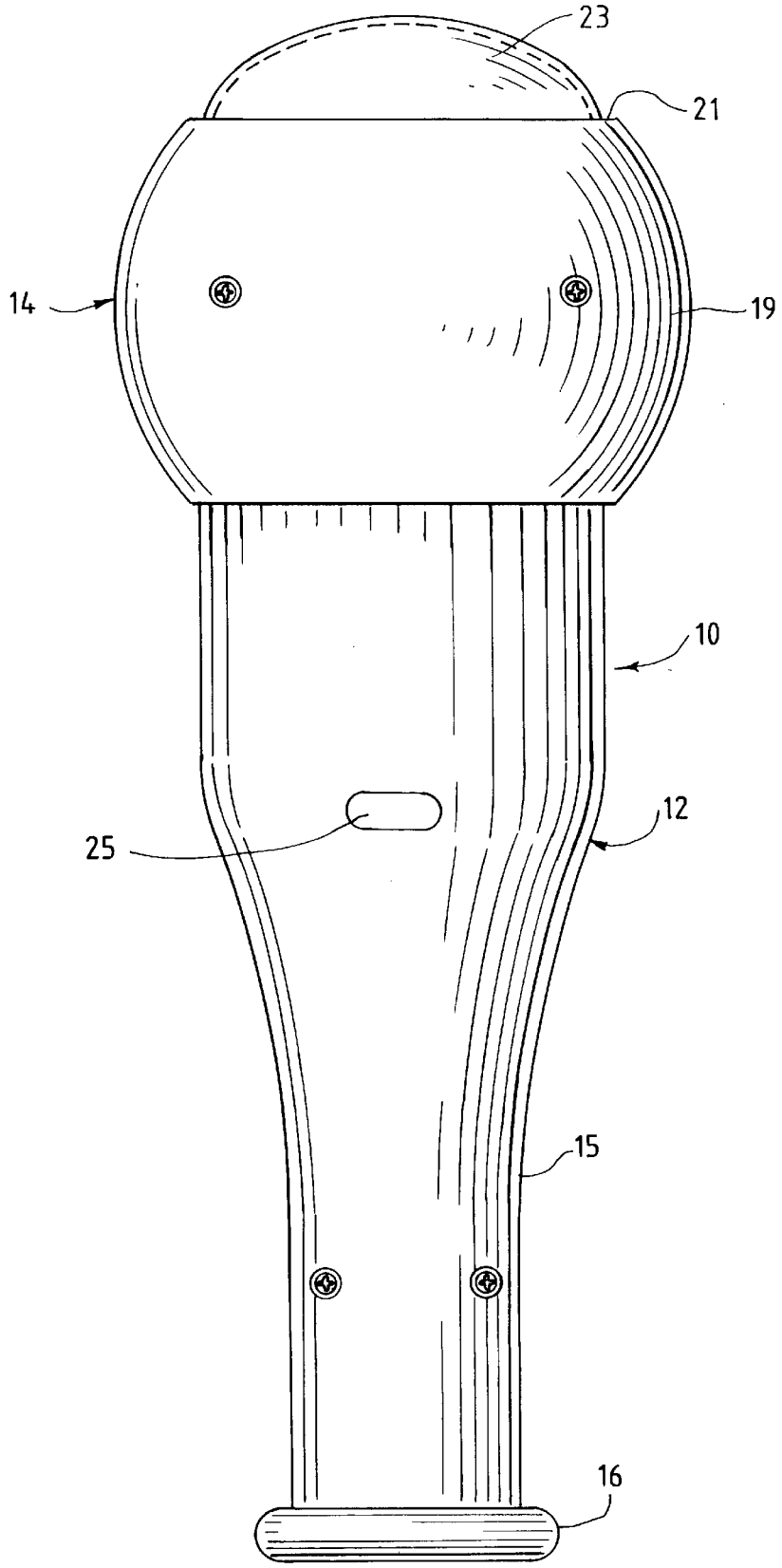
FIG. 1 is a side elevational view showing the promotional amusement device in the closed position.

With reference to FIG. 1 of the drawings, the promotional amusement device is illustrated generally by the numeral 10. The amusement device 10 is formed by a lower handle portion 12, and an upper handle portion 14. The lower handle portion 12 includes a grip section 15 and terminates at a lower base 16. The lower base 16, as depicted in FIGS. 2 and 3, is provided with a concavity 17 which is provided for a purpose to be more fully described hereinafter.

The upper handle portion 14 is shown to be formed in the configuration of a spherical globe 19 which has an open top end 21. The open top end is enclosed by a top cap 23 which will be more fully described hereinafter. As depicted in FIG. 1, a release button 25 is provided which functions to release the tubular members in a manner which will be more fully described hereinafter.

Figure 2:
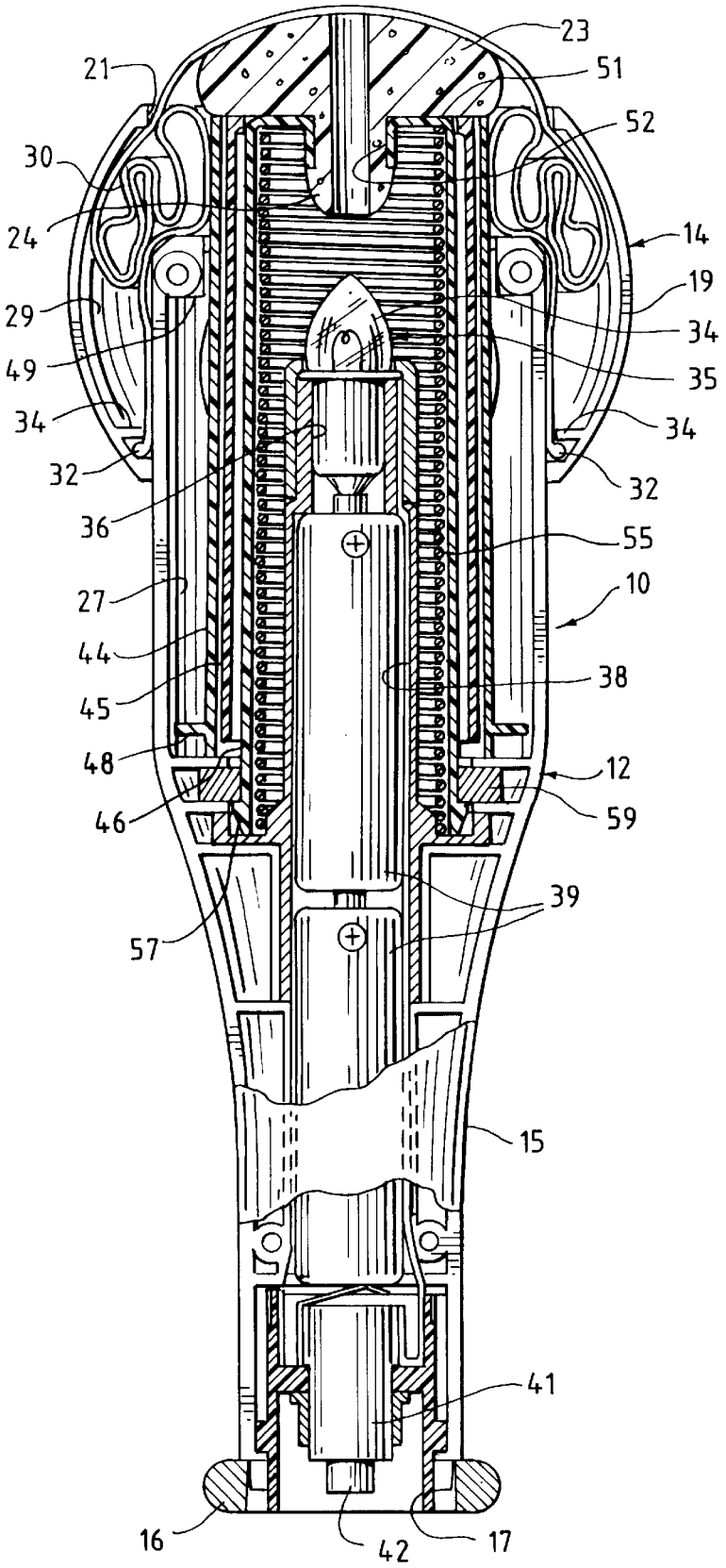
FIG. 2 is a side elevational view in cross section, showing the detailed construction of the promotional amusement device.
Figure 3:
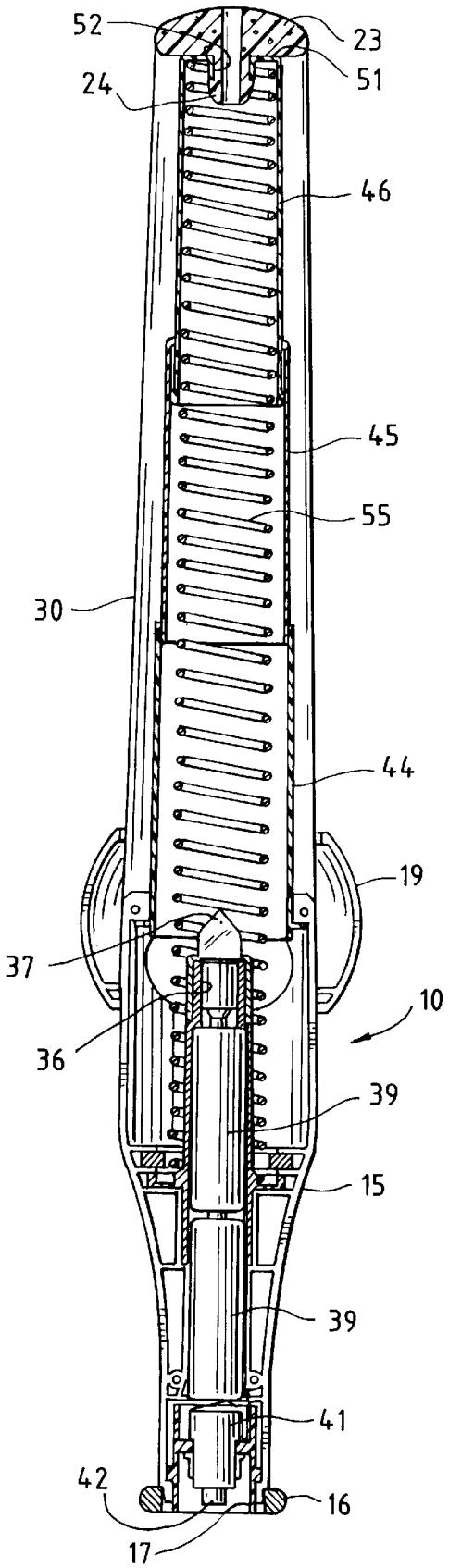
FIG. 3 is a side elevational view, in cross section, showing the promotional amusement device in is fully extended position.

Referencing now FIGS. 2 and 3 of the drawings, the details of construction of the promotional amusement device 10 are illustrated. It will be observed that the lower handle portion 12 and upper handle portion 14 are formed to include a lower handle chamber 27, and an upper handle chamber 29. In connection with the embodiment as depicted in FIG. 2 of the drawings, it will be observed that the upper handle chamber 29 overlaps and is seated around the upper portion of the lower handle chamber 27, and provides a nesting storage compartment for the transparent stretchable boot 30. The spherical globe 19 forming the upper handle chamber 29 is secured to the lower handle portion 12 by any suitable means such that once secured, the upper spherical globe 19 will remain in place thereon.

The transparent stretchable boot 30 is provided with a lower retaining ring 32 which is secured to the lower end of the boot 30, such as by stiching or other appropriate means, and is retained in position relative to the spherical globe 19 by means of a retainer ledge 34 which is formed along the inner periphery of the spherical globe 19. In this manner, the lower end of transparent stretchable boot 30 is secured within the confines of the spherical globe 19, and is adapted such that when in the nested storage posture, the boot 30 is retained within the spherical globe 19.

The lower handle chamber 27 is shown to accommodate the positioning therein of a light source 35 which generally consists of a bulb housing 36 in which is positioned bulb 37, and a battery compartment 38 which contains a pair of batteries 39. The lower end of the lower handle chamber 29 is provided with a switch mechanism 41 which is in electrical contact with the batteries 39 and the light bulb 37 in a manner typical of flash lights and as is well-known in the art. Activation of the switch 42 will either energize or de-energize the light bulb 37 again, as is well-known in the art. The switch mechanism 41 and especially the switch mechanism 42 is located in the concavity portion 17 of the base 15 which is convenient for the user since the device may then be stood on the base 16 into an upright position for storage purposes without the switch 42 interfering with the ability of the device 10 to stand upright.

The lower handle chamber 29 is shown to further accommodate a series of three tubular members consisting of an outer tubular member 44, a central tubular member 45, and an inner tubular member 46. The respective tubular members 44, 45 and 46 are arranged in telescoping arrangement, such that they may be telescopingly extended outwardly of the device 10 into a fully extended position as shown in FIG. 3. It will be observed that the outer tubular member 44 includes a stop flange 48 which coacts with a stop boss 49 located along the top portion of the lower handle chamber, and as shown in FIG. 3, when the respective tubular members 44, 45 and 46 are fully extended, the stop flange 48 will rest against the stop boss 49 thereby to arrest any further movement of the tubular members beyond their fully extended open position.

Each of the tubular members 44, 45 and 46 respectively, are shown to be formed in a tapered configuration with the larger diametric dimension toward the bottom of each tube, and the smaller diametric dimension adjacent the upper portion of each tube. This configuration is shown in FIG. 3 of the drawings. Hence, it will be appreciated that when the tubular members 44, 45 and 46 are extended into the fully extended open position, the lower larger diametric dimension of each tube will ride up and engage the upper smaller diametric dimension of the adjacent tubular member thereby to snug against the surface thereof, and facilitate the pulling movement of pulling central tubular member 45 and inner tubular member 46 to the fully extended position. It will also be observed that the inner tubular member is provided with a top cap 23 which is secured to the top surface of an upper ledge 51 forming the top of the inner tubular member 46. It will be observed in FIG. 2, the top cap 23 is secured in place onto the upper surface of the upper ledge 51, and includes a plug portion 24 which seats within a central aperture 52 formed in the upper ledge 51. It will also be observed that the transparent stretchable boot 30 extends over the top of the top cap 23 and forms the outer surface of top cap 23.

The assembly is completed by means of a coil spring 55 which is sized to be fitted within the diametric confines of the inner tubular member 46. The upper portion of the coil spring 55 rests against the under surface of the upper ledge 51 and is thereby encapsulated within the device 10.

It will be observed that with respect to FIG. 2 of the drawings that the lower end of the inner tubular member 46 is provided with a lock flange 57, which coacts with a lock catch 59 formed along the central portion of the lower handle portion 12. The lock catch 59 is in operative relation with release button 25, such that upon manual pressure being applied to the release button 25, the lock catch 59 is pulled away from the lock flange 57 thereby to release the inner tubular member 46. As is shown in FIG. 3 of the drawings, when the inner tubular member 46 is released, the coil spring 55 will operate to extend the inner tubular member 46 upwardly, which will then snug against and pull the central tubular member 45 upwardly, which will in turn snug against and pull the outer tubular 44 until the tubular members 44, 45, and 46 are extended to their fully open position, with the stop flange 48 being arrested by stop boss 49. Concomitantly, as the tubular members 44,45, and 46 become fully extended, the boot 30 is pulled upwardly in view of the fact that the boot 30 is carried over the top cap 23 and is thereby pulled out of the nested storage position as shown in FIG. 2, to its fully extended position as shown in FIG. 3. Once in the fully extended position as illustrated in FIG. 3, the operator may activate the switch 42 to thereby energize the light source 35, which then lights up the interior portion of the device 10.

It is contemplated that the boot 30 is made of a transparent material which is permeable to light. Similarly, it is contemplated that the lower handle portion 12 of the device, including the spherical globe 19 as well as a portion of the lower handle portion 12 is made of a plastic material which will again be somewhat light permeable. In this manner, it is contemplated that promotional indicia may be imprinted on the spherical globe 19 of the handle 12, as well as on the boot, such that once the boot 30 is extended to its fully open position as shown in FIG. 3, the promotional indicia contained thereon will be displayed. If the light source 35 is then energized, the indicia will be lighted such that the promotional message contained thereon will be visible at night as well.

To close the device, the operator would simply press against the top cap 23 thereby pushing downwardly on the tubular members against the force of the coil spring 55, until the innermost tubular member 46 is again locked into position by having the lock flange 57 engage the lock catch 59.

It is further contemplated that the top cap 23 be formed of a resinous foam material which will be soft to the touch, and therefore eliminate any possibility of injury to the user in the event that the device is activated to release the tubular members into their fully extended position when the device is pointed at the face or eyes of the user. Furthermore, as a further safety feature, it is contemplated that the coil spring 55 which is employed will have a spring rate of not more than five coils per second such that a soft coil spring will be employed in order to eliminate any sudden bursting motion of the tubular members being extended upwardly to their fully open position. The selection of the proper spring rate for the coil spring will therefore ensure that the tubular members are fully opened to their fully extended position in a reasonably slow fashion such that sudden movement of the device will not cause any injury to the user.

It will be appreciated that the present device therefore permits a variety of indicia to be imprinted thereon and may be used to promote either a product, or a service. For example, it is contemplated that the device as depicted in FIG. 1 could be used as a promotional device for a baseball team by imprinting a baseball on the spherical globe portion 19, while a particular baseball team logo be imprinted on the boot 30. It will be appreciated that since the device 10 is provided with a light source 35, the device may be used at night-time events, such as night baseball games, and the user would therefore have the ability to energize the device so that it can be seen at night. Other uses which would be permitted would include the imprinting of animal designs for use at circus events or product logos for use at any time for promoting a given product.

In addition, the spherical globe portion 19 may be formed in other geometric shapes, such as for example a football shape which then permits the device to be used as a promotional devise for different sports teams. Hence, designs simulating a hockey puck, golf ball, and the like is contemplated.

To further expand the usefulness of the device, the spherical globe portion 19 may be designed to be removable from the handle such as by being screw-threaded thereon. In this manner, the entire device excepting the globe portion may be mass produced and the particular globe portion for a particular customer mounted thereon. In this manner, only the globe portion and the boot would be custom manufactured for a particular customer intending to use the device as a promotional amusement device.

While there has been described what is at present considered to be the preferred embodiment of the invention, it will be understood that various modifications may be made therein, and it is intended to cover in the appended claims all such modifications as fall within the true spirit and scope of the invention.

I claim:

1. A promotional amusement device comprising in combination, an elongate handle member forming an upper handle chamber having an open top end and a lower handle chamber terminating in a base, a tube element having an upper end and a lower end, said tube element being positioned within said lower handle chamber and moveable between an open extended position and a closed nested position from within said lower handle chamber, said upper end of said tube element provided with a top cap affixed thereto and adapted to enclose said open top end of said upper handle chamber, a transparent stretchable boot having a lower end secured within said upper handle chamber and overlying said top cap, said boot being moveable between a nested storage position within said upper handle chamber and a fully stretched open position, in response to movement of said tube element, means for affecting movement and springing said tube element between the closed nested position and the open extended position, means for lockingly engaging said tube element in the closed nested position and being releasable to permit said tube element to be extended into the open extended position by said means for springing said tube element, said lower handle chamber provided with a light source and a power means for energizing said light source and including a switch means for alternately energizing and de-energizing said light source, said handle, boot and top cap each being adapted to carry imprinted promotional indicia, whereby upon the movement of said tube element and boot to the fully stretched open position, the indicia is displayed and upon activation of said light source, said indicia is lighted.

2. The promotional amusement device as set forth in claim 1 above, wherein said tube element comprises a plurality of tubular members, the plurality of tubular members further defining a series of three telescopically arranged tubular members including an inner most tubular member, a central tubular member and an outer most tubular member each arranged in telescoping relation to each other, each of said tubular members being tapered between a larger lower diametric dimension and a smaller upper diametric dimension and adapted to be arranged in a closed nested position, and telescopically extended by said means for springing said tube element into the open extended position.

3. The promotional amusement device as set forth in claim 2 above wherein said upper handle chamber is formed into a spherical globe configuration having an open top end and said top cap is affixed to the inner most tubular member and is formed as a spherical cap thereby to seat over and enclose said open top end of said spherical globe when in the closed nested position.

4. The promotional amusement device as set forth in claim 3 above, wherein said transparent stretchable boot is adapted to be nested within said spherical globe upper handle chamber when in the nested storage position, and is moveable to the fully stretched open position in response to telescopically extending of said tubular members to the open extended position.

5. The promotional amusement device as set forth in claim 2 above wherein said means for lockingly engaging said tube element includes a lock catch carried in said lower handle chamber and a lock flange formed on said inner most tubular member such that said lock flange is engageable with said lock catch, and including a lock catch release which co-acts with said lock catch which, when activated, releases said lock catch from engagement with said lock flange and permits said means for springing said tube element to the open extended position and concomitantly extend said boot to the fully stretched open position.

6. The promotional amusement device as set forth in claim 3 above, wherein said top cap is formed from a soft resinous foam material.

7. The promotional amusement device as set forth in claim 2 above, wherein said elongate handle member includes a lower grip portion terminating at a lower end and a concave base, and said switch means for energizing and de-energizing said light source positioned within said concave base.

8. The promotional amusement device as set forth in claim 2 above, wherein said handle member, top cap and transparent stretchable boot are formed of a material which is light permeable such that upon activation of said light source, said promotional indicia is lighted for display purposes.

9. The promotional amusement device as set forth in claim 2 above, wherein said lower handle chamber is provided with a stop boss and said outer most tubular member is provided with a stop flange whereby said stop flange engages said stop boss when said tubular members are extended to the open extended position thereby to provide a stop position for said tubular members when in the open extended position.

10. The promotional amusement device as set forth in claim 2 above wherein said transparent stretchable boot is provided with an attachment ring affixed at the lower end of said boot and said upper handle chamber is provided with a retainer ledge whereby said attachment ring seats under and is engaged by said retainer ledge to lock the lower end of said boot into said upper handle chamber.

11. The promotional amusement device as set forth in claim 2 above wherein said means for springing said tube element comprises a coil spring having a spring tension rate not exceeding five coils per second.

12. A promotional amusement device comprising in combination, an elongate handle member forming an upper handle chamber having an open top end and a lower handle chamber terminating in a base, a plurality of tubular members arranged in telescoping relation to each other, including at least an inner most tubular member and outermost tubular member, each of said tubular members having an upper end and a lower end, each of said tubular members being tapered between a larger lower diametric dimension and a smaller upper diametric dimension and adapted to be arranged in a closed nested position within the lower handle chamber, and moved telescopically into a fully extended position, a top cap affixed to the upper end of said innermost tubular member and adapted to enclose said open top end of said upper handle chamber, a transparent stretchable boot having a lower end secured within said upper handle chamber and overlying said top cap, said transparent stretchable boot being moveable between a nested storage position within said upper handle chamber and an open extended position, in response to the telescopic movement of said tubular members, means for affecting movement of said tubular members, telescopically, between the closed nested position and into the fully extended position, means for lockingly engaging said tubular members in the closed nested position and being releasable to permit said tubular members to be moved into the fully extended position, the movement of said tubular members into the fully extended position being arrested as the larger lower diametric dimension of one tubular member comes into contact with the smaller upper diametric dimension of another tubular member, said lower handle chamber provided with a light source and a power means for energizing said light source and including a switch means for alternately energizing and de-energizing said light source, and said handle member, boot and top cap being adapted to carry imprinted promotional indicia whereby upon the telescopic movement of said tubular members and boot to the open extended position, the indicia is displayed and upon activation of said light source, said indicia is lighted.

13. A promotional amusement device comprising in combination, an elongate handle member having an upper handle chamber having an open top end and a lower handle chamber terminating in a base, said upper handle chamber being formed into a spherical globe configuration having an open top end, and a lower portion of said elongate handle member being formed into a lower grip portion terminating at a lower end and a concave base, a series of three telescopically arranged tubular members carried within said lower handle chamber, including an inner most tubular member, a central tubular member, and an outer most tubular member, each tubular member having an upper end and a lower end, each of said tubular members being tapered between a larger lower diametric dimension and a smaller upper diametric dimension and adapted to be arranged in a closed nested position within said lower handle chamber, and moved through telescopic extension when urged into a fully extended position, a top cap affixed to the upper end of said inner tubular member and adapted to enclose said open top end of said upper handle chamber, a transparent stretchable boot having a lower end secured within said upper handle chamber and overlying said top cap, said boot being moveable between a nested storage position within said upper handle chamber and an open extended position in response to the telescopic extension of said tubular members to the fully extended position, means for affecting movement of said tubular members between the closed nested position and the fully extended position, means for lockingly engaging said tubular members in the closed nested position and being releasable to permit said tubular members to be extended into the fully extended position by said means for affecting movement, said lower handle chamber provided with a light source and a power means for energizing said light source and including a switch means for alternately energizing and de-energizing said light source, said switch means being positioned within said concave base, and said handle member, boot and top cap being adapted to carry imprinted promotional indicia, whereby upon movement of said tubular members to the fully extended position and boot to the open extended position, the indicia is displayed and upon activation of said light source, said indicia is lighted.

14. The promotional amusement device as set forth in claim 13 above, wherein said handle member, tubular members, and transparent stretchable boot are formed of a material which is light permeable such that upon activation of said light source, said promotional indicia is lighted for display purposes.

15. The promotional amusement device as set forth in claim 13 above, wherein said lower handle chamber is provided with a stop boss and said outer most tubular member is provided with a stop flange whereby said stop flange engages said stop boss when said telescoping tubular members are in the fully extended position.

16. The promotional amusement device as set forth in claim 13 above, wherein said transparent stretchable boot is provided with an attachment ring affixed at a lower end of said boot and said upper handle chamber is provided with a retainer ledge whereby said attachment ring seats under and is engaged by said retainer ledge to lock the lower end of said boot into said upper handle chamber.

17. The promotional amusement device as set forth in claim 13 above, wherein said means for affecting movement of said tubular members comprises a coil spring having a spring extension rate not exceeding five coils per second.

* * * * *